United States Patent [19]

Roericht

[11] 4,130,263

[45] Dec. 19, 1978

[54] CHAIRS

[75] Inventor: Hans Roericht, Ulm, Fed. Rep. of Germany

[73] Assignee: Wilkhahn, Wilkening & Hahne, Eimbeckhausen, Fed. Rep. of Germany

[21] Appl. No.: 807,664

[22] Filed: Jun. 17, 1977

[51] Int. Cl.[2] ..... F16M 13/00

[52] U.S. Cl. ..... 248/371; 248/158; 248/346; 248/397; 297/461

[58] Field of Search ..... 248/371, 397, 158, 346; 297/461

[56] References Cited

U.S. PATENT DOCUMENTS

| | | | |
|---|---|---|---|
| 180,806 | 8/1876 | Striegel | 248/397 |
| 483,266 | 9/1892 | Schindler | 248/397 |
| 2,219,974 | 10/1940 | Bellow | 248/346 |
| 2,669,283 | 2/1954 | Faulhaber | 248/397 |
| 2,806,131 | 9/1957 | Palmer | 248/346 |
| 3,312,437 | 4/1967 | Barth | 248/158 |
| 3,767,094 | 10/1973 | Sikes | 248/346 |

FOREIGN PATENT DOCUMENTS

| | | | |
|---|---|---|---|
| 994741 | 8/1976 | Canada | 248/158 |
| 2109129 | 8/1972 | Fed. Rep. of Germany | 248/371 |

*Primary Examiner*—Marion Parsons, Jr.
*Attorney, Agent, or Firm*—Larson, Taylor and Hinds

[57] ABSTRACT

A pedestal stool is disclosed having a base carrying a stem on which a seat portion is supported.

The base includes a sand-filled, bulbous, ground-engaging bag or sack to enable the stool to be tilted at any angle and held at that angle by virtue of the change in shape of the sack in response to the resultant flow of sand which produces a new equilibrium position for the stool.

7 Claims, 2 Drawing Figures

CHAIRS

BACKGROUND OF THE INVENTION

1. Field of the Invention

The present invention relates to seats and in particular to pedestal stools of the type in which a seat portion is supported on a base by a single stem.

2. Description of the Prior Art

Previously proposed pedestal stools have a heavy hemispherical or spheroidal base of homogenous rubber into which the base of the stem of the seat has been molded. The upper end of the stem carries a seat portion. When a person is seated, the stem will tilt against the resilience of the rubber base into whatever attitude the occupant of the seat causes it to move under their weight. The disadvantage of such a pedestal seat is that when the occupant leaves the stool the stem will spring back into its original position (the Kelly effect) under the resilience of the rubber base. If there are objects (e.g. a desk) or persons in the vicinity of the seat they could receive a blow from the seat and damage may well be inflicted.

It is an object of the invention to provide an improved pedestal stool.

It is a further object of the invention to overcome the disadvantage of the previously proposed pedestal stool.

SUMMARY OF THE INVENTION

According to the invention there is provided a seat comprising a seat portion, a stem carrying the seat portion, and a base supporting the stem, the base including a support, a ground-engaging flexible bag secured to the support and, together with the support, defining a chamber, and particulate material substantially filling the support and flowable in the bag to change the shape of the bag in response to displacement of the bag produced by a tilting of the stem whereby to hold the seat in equilibrium in its tilted state.

According to the invention there is further provided a pedestal stool comprising a base having an inverted dished support defining a stem engaging opening, a ground-engaging, flexible, bag secured to the support to form a bulbous extension from the underside of the support, and defining with the support an enclosed chamber, and sand filling the enclosed chamber to flow within the chamber in response to a displacement of the bag resulting from a tilting of the support whereby to set up a new position of equilibrium in which the support when released will be held in its tilted state, an elongate stem having a lower and upper end portion, the lower end portion being engaged in the opening in the support, and a seat portion mounted on the upper end portion of the stem.

BRIEF DESCRIPTION OF THE DRAWINGS

A pedestal stool embodying the invention will now be described with reference to the accompanying diagrammatic drawing in which.

DESCRIPTION OF THE PREFERRED EMBODIMENTS

The pedestal stool to be described is suitable for providing support for persons required to remain in a generally erect posture for protracted periods. It is particularly suitable for sales persons in department stores and counter staff in savings banks and the like.

Figure 1:
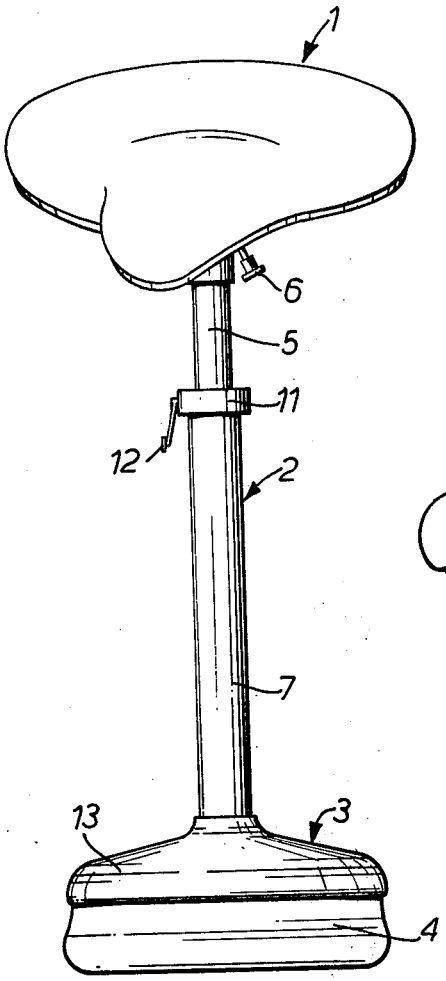
FIG. 1 is a perspective view of the stool.
Figure 2:
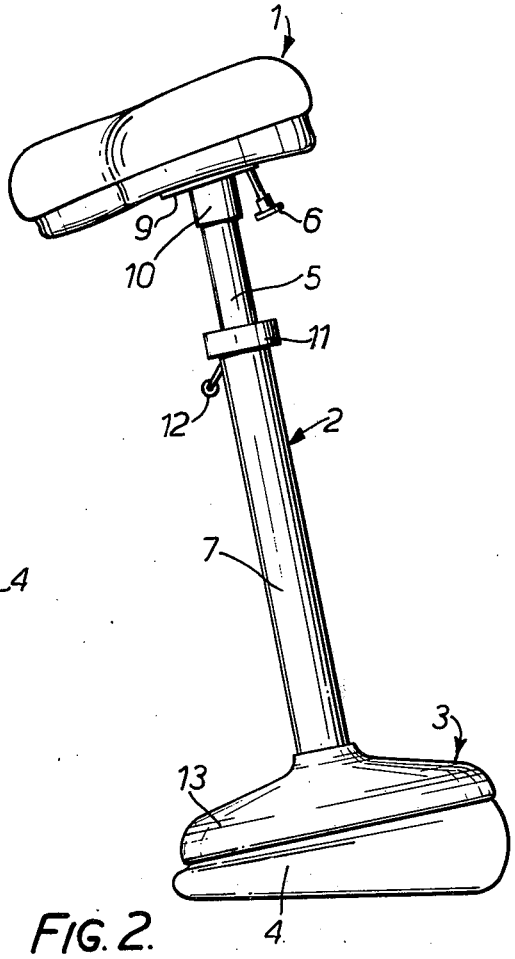
FIG. 2 is another perspective view of the stool with the stool in an inclined attitude.

As shown in FIGS. 1 and 2 the pedestal stool has a moulded or padded seat portion 1 supported on a base 3 by a stem or pillar 2. The seat portion 1 has a base plate 9 which is coupled to a collar 70 at the upper end of the stem 2 by a universal joint (not shown). A clamping device (not shown) having an actuation lever 6 is operable to release the joint so that the attitude of the seat portion 1 with respect to the stem 2 can be adjusted as desired. Thereafter operation of the lever 6 will lock the seat portion in the desired attitude. The stem 2 includes a lower cylindrical member 7 which slidably houses a rod 5. A clamping device 11 mounted at the upper end of the member 7 and having an actuating lever 12 is operable to clamp the member 7 and the rod 5 in any selected relative position thus allowing the height of two seat portion 1 to be adjusted. The rod 5 carries the collar 10 at its upper end. The base 3 includes a generally rigid, inverted, cup-shaped support 13 having a central opening which is engaged by the lower end of the member 7; the member 7 being made rigid with the support 13. A flexible bag 4 is secured to the rim of the cup-shaped support 13 and together with the support 13 defines an enclosed chamber. This chamber is filled with granular material, for example, sand. The volume of the chamber is selected so that when filled with sand the weight of the sand will prevent the stem and seat portion from toppling over. When the stool is in the upright position shown in FIG. 1 and is tilted so as to be inclined to the vertical (see FIG. 2) the bag 4 is displaced and the sand in the bag flows under gravity to find a fresh equilibrium position in which it holds the stool in the inclined position. The seat will therefore not spring back to the vertical when released following tilting.

Instead of sand other granular or particulate materials such as plastics can be used.

It will be appreciated that since the stool is in equilibrium in whatever attitude it is shifted there will be no danger of the stool accidentally damaging objects in the vicinity when the stool is vacated.

The flexible bag 4 is advantageously of leather but it can be of other materials such as plastics or cloth.

I claim:

1. A seat comprising
   - a seat portion,
   - a stem carrying the seat portion, and
   - a base supporting the stem, the base including
     - a support,
     - a ground-engaging flexible bag secured to the support and, together with the support, defining a chamber, and
     - particulate material substantially filling the support and flowable in the bag to change the shape of the bag in response to displacement of the bag produced by a tilting of the stem whereby to hold the seat in equilibrium in its tilted state.

2. A seat according to claim 1, wherein the flexible bag is of leather.

3. A seat according to claim 1, including means for telescopically adjusting the length of the stem.

4. A seat according to claim 1, including means for adjusting the attitude of the seat portion on the stem.

5. A seat according to claim 1, wherein the particulate material is sand.

6. A pedestal stool comprising
   - a base having an inverted dished support defining a stem engaging opening, a ground-engaging, flexible, bag secured to the support to form a bulbous extension from the underside of the support, and defining with the support an enclosed chamber, and sand filling the enclosed chamber to flow within the chamber in response to a displacement of the bag resulting from a tilting of the support whereby to set up a new position of equilibrium in which the support when released will be held in its tilted state, an elongate stem having a lower and upper end portion, the lower end portion being engaged in the opening in the support, and a seat portion mounted on the upper end portion of the stem.

7. A stool according to claim 6 wherein the flexible bag is of leather.

* * * * *